United States Patent [19]

Hershberger

[11] 4,411,421

[45] Oct. 25, 1983

[54] THERAPEUTIC APPARATUS

[76] Inventor: Vilas D. Hershberger, R.R. #1, Hesston, Kans. 67062

[21] Appl. No.: 303,931

[22] Filed: Sep. 21, 1981

[51] Int. Cl.[3] ..... A63B 21/00

[52] U.S. Cl. ..... 272/73; 128/57; 272/127; 272/134; 272/DIG. 4

[58] Field of Search ..... 272/127, 136, 137, 142, 272/116, 134, 73; 128/56, 57, 61

[56] References Cited

U.S. PATENT DOCUMENTS

| | | | |
|---|---|---|---|
| 3,915,158 | 10/1975 | Simjian | 128/56 |
| 4,026,279 | 5/1977 | Simjian | 128/57 X |
| 4,036,219 | 7/1977 | Simjian | 128/57 X |
| 4,266,536 | 5/1981 | Casares | 128/57 |

*Primary Examiner*—Richard C. Pinkham
*Assistant Examiner*—William R. Browne
*Attorney, Agent, or Firm*—Robert E. Breidenthal

[57] ABSTRACT

Therapeutic apparatus having a frame that includes a pair of laterally spaced A-frames in part defined by a user's seat extending therebetween and seat supports. A pair of independent tubular guides are connected to the apices of the A-frames for pivotal movement about aligned transverse axes, and each of the guides has an elongated and resiliently extensible operating element reciprocably extending therethrough that is provided at its forward end with a laterally extending handle and at its rear end with a laterally extending and spring-mounted roller that is engageable with the user's back upon the user urging the operating element forwardly in its guide. Rocking of a guide and its element in a vertical plane by the user manipulating the associated handle causes the associated roller to roll up and down against the user's back. A foot operable crank is mounted at a position below and forwardly of the seat to enable the user to exercise his legs while exercising his arms and shoulders to massage his back.

17 Claims, 10 Drawing Figures

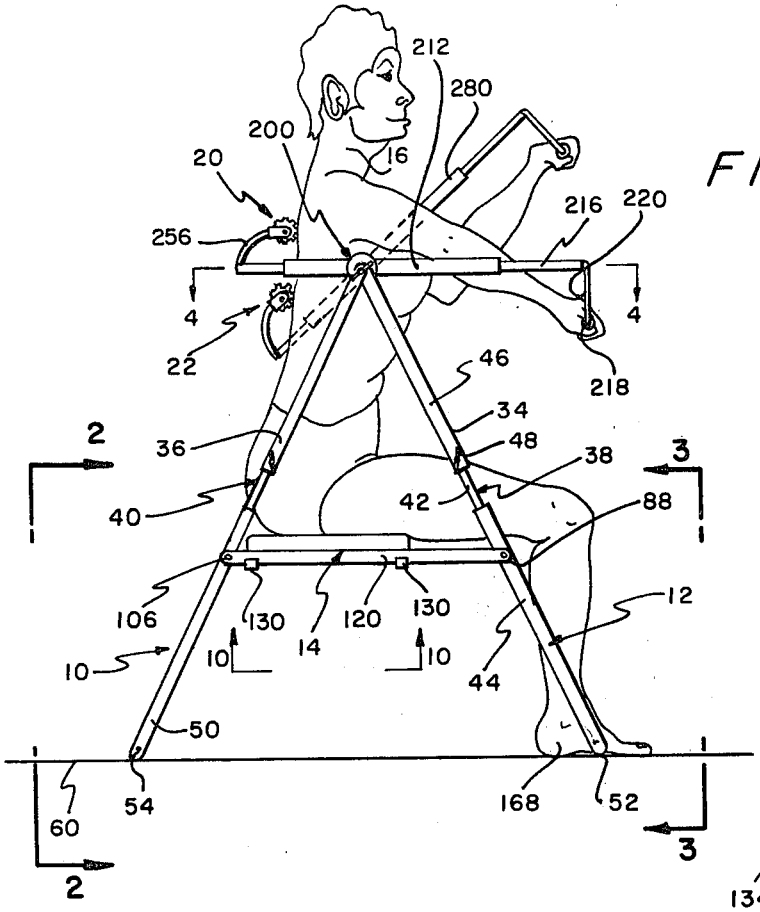
FIG. 1
FIG. 10
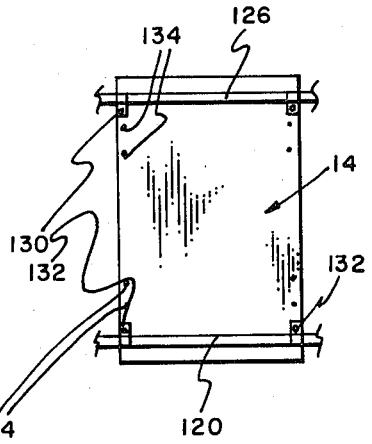
FIG. 2
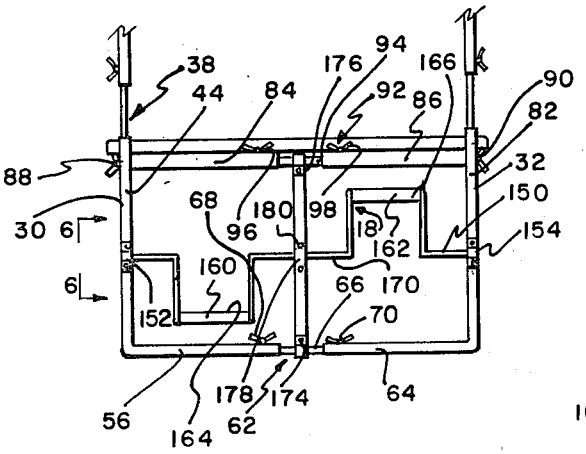
FIG. 3
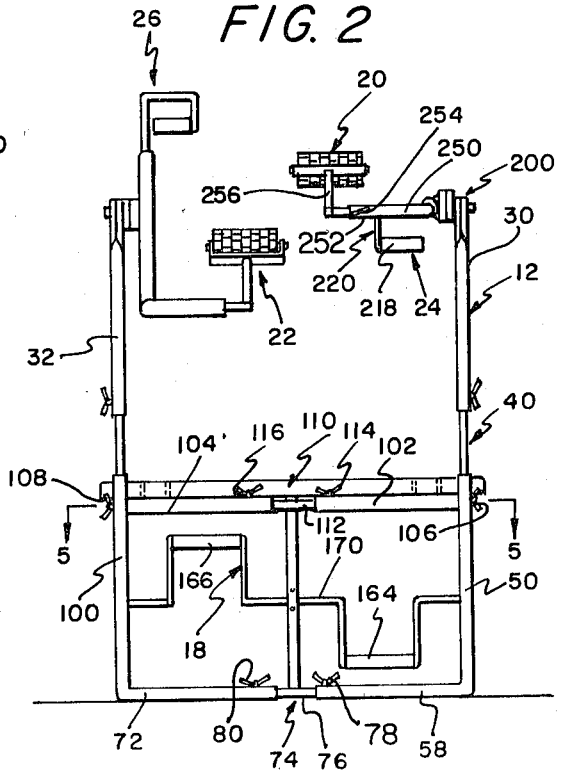

FIG. 4
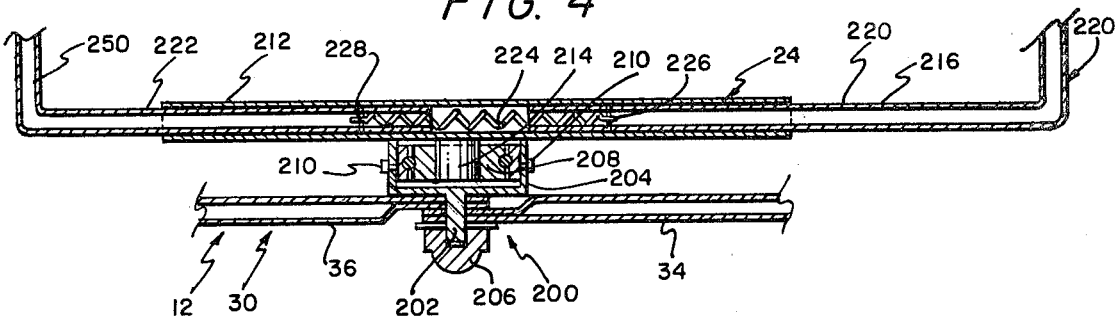
FIG. 5
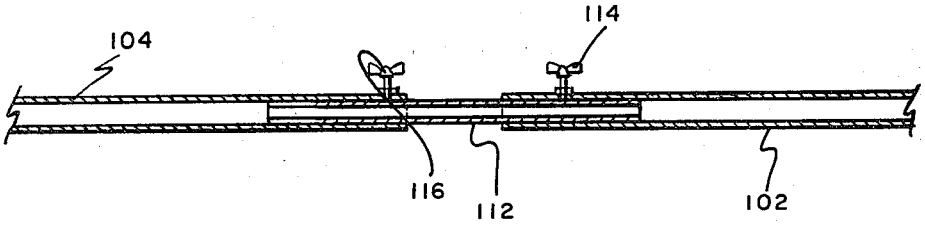
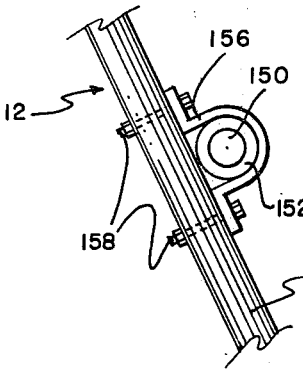
FIG. 6
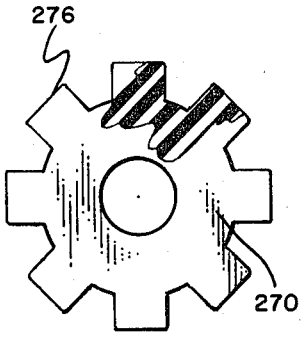
FIG. 8
FIG. 7
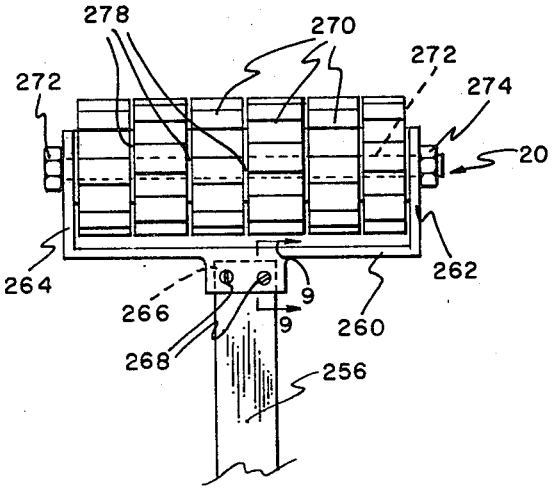
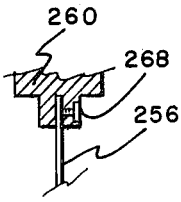
FIG. 9

THERAPEUTIC APPARATUS

The present invention relates to new and useful improvements in therapeutic apparatus, and more particularly pertains to apparatus which may be termed an exerssage for exercising portions of the body while applying some of the energy expended during exercise to message the back of the user.

It appears beyond dispute that exercise in the form of muscle and/or joint flexure, with or without substantial opposing resistance, is or can be quite beneficial to a person engaging in such exercise both physically and mentally and this is true usually whether or not the person has any specific mental or physical problems. In short, exercise is ordinarily excellent therapy for those with actual physical and/or mental ailments as well as for those not so afflicted.

Massage is also well recognized as an excellent therapy productive of both mental and physical benefits. Such is helpful to those with mental and/or physical problems and is of value as a preventive measure for those not so affected. With respect to a large portion of an individual's body, such individual can easily massage such region, but it should be noted in passing that in the sometimes perverse way of things, a very important portion of the body most needful of massage, namely, the back, is extremely difficult if not impossible to massage personally.

It is the paramount objective of the instant invention to provide an axerssager or therapeutic apparatus that enables the user to exercise while simultaneously efficiently and very effectively massaging the back.

Ancillary objectives are to enable the user to exercise his arms and legs at the same time while in a seated position.

Literature abounds with respect to exercising apparatus generally, and of such the following are of substantial background interest as they pertain to massaging apparatus, some of which are user actuated:

U.S. Pat. No. 4,193,394—Everett et al.—Mar. 18, 1980
U.S. Pat. No. 1,572,794—Hamilton—Feb. 9, 1926
U.S. Pat. No. 2,819,714—London—Jan. 14, 1958
U.S. Pat. No. 3,120,953—London—Feb. 11, 1964
U.S. Pat. No. 2,328,156—London—Aug. 31, 1943
U.S. Pat. No. 3,164,150—Reid—Jan. 5, 1965
U.S. Pat. No. 1,836,981—Matheson—Dec. 15, 1931
U.S. Pat. No. 3,707,284—Waldeck—Dec. 26, 1972
U.S. Pat. No. 2,593,982—Cash—Apr. 22, 1952
U.S. Pat. No. 1,776,806—Carlson—Sept. 30, 1930

It is believed that the first listed above comes closest to the instant invention as the same allows a semiprone person to massage his back on moving the arms.

Broadly, the instant invention involves therapeutic apparatus comprising a frame, a pair of laterally spaced guide means pivotally mounted on the frame for vertical swinging movement about aligned horizontal axes, an elongated operating means operatively associated with each of said guide means so as to be guided by the latter for longitudinal reciprocation between forward and rear positions relative thereto, each of said operating elements having forward and rear ends with a handle foxed to the forward end, and each of said operating elements being provided at its rear end with a back massaging means that is laterally offset toward the other operating element, whereby a forwardly facing user positioned between the laterally spaced guide means can manipulate the handles to cause the massaging means to contact his back with a manually controllable force while moving upwardly and downwardly thereagainst.

A more sophisticated aspect of the invention involves the apparatus set forth in the preceding paragraph that includes a seat for the user, together with a laterally extending crankshaft mounted on the frame for rotation about a horizontal axis that is parallel to the previously mentioned axes and disposed below the seat, said shaft having two throws that are 180° apart in rotation that are adapted to accommodate the feet of the user as pedals, whereby a seated user can exercise his legs.

The foregoing as well as other features, advantages and objectives will become apparent in the light of the ensuing description of a preferred embodiment of the invention, such description being given in conjunction with the accompanying drawings illustrate of such embodiment, wherein:

FIG. 1 is a side elevational view of the invention showing the user operating the same, with certain hidden parts being shown in dashed outline; and with the leg exerciser attachment removed;

FIG. 2 is a rear view of the apparatus of FIG. 1 taken from the plane of the line 2—2 in FIG. 1 and showing the same with the leg exerciser attached;

FIG. 3 is a fragmentary front view of the apparatus shown in FIG. 2, the view being taken generally from the plane of the line 3—3 in FIG. 1;

FIG. 4 is an enlarged fragmentary, horizontal sectional detail view taken upon the plane of section line 4—4 in FIG. 1;

FIG. 5 is an enlarged fragmentary, horizontal sectional detail view of a portion of the leg exerciser structure taken upon the plane of the section line 5—5 in FIG. 2;

FIG. 6 is an enlarged fragmentary side view of the bearing structure of the leg crank taken from the plane of the line 6—6 in FIG. 3;

FIG. 7 is an enlarged fragmentary detail view of one of the roller massaging means, with hidden parts being shown in dashed outline;

FIG. 8 is an enlarged axial view of one of the individual rollers of the structure shown in FIG. 7, with a portion being broken away to illustrate by sectioning the elastomeric character of the same;

FIG. 9 is a fragmentary sectional detail view taken upon the plane of the section line 9—9 in FIG. 7, and illustrates the manner the roller structure is detachably mounted on the resilient support arm therefor; and, FIG. 10 is a fragmentary bottom view taken from the plane of the line 10—10 in FIG. 1 illustrating particularly means for accommodating the seat to width adjustments of the apparatus.

Referring now to the drawings wherein like numerals designate like parts throughout the various views, the reference numeral 10 designates the exerssage of therapeutic apparatus generally, the same being comprised of a frame 12 that carries a seat 14 for a user 16, a detachable leg exerciser means 18, and a pair of back massaging means 20 and 22 carried by arm excerising or manually actuable means 24 and 26, respectively, that are pivotally mounted at laterally spaced positions on the frame 12.

Proceeding now with a detailed description of the components outlined above, the frame 12 comprises two laterally spaced sections 30 and 32 that are mirror images of each other. Accordingly, a description of section 30 will suffice for both.

The frame section 30 comprises a pair of front and rear tubular elements 34 and 36 that diverge downwardly for a pivotal connection of the upper ends that will be described subsequently. The tubular elements 34 and 36 are provided respectively with conventional means 38 and 40 intermediate their vertical extents for affording adjustability in their vertical extents. Such conventional means includes in the case of the means of a reduced extension 42 fixed to a lower portion 44 of the tubular element 34 that is telescopingly received in the lower end of an upper portion 46 of the tubular element 34. A clamping screw 48 threaded in the upper portion 46 is provided to engage the extension 42 and thereby releasably secure the frame portions 44 and 46 in adjusted relationship. The means 40 is similar to the means 38 and its structure does not require elaboration.

The lower portions 44 and 50 of the tubular elements 34 and 36 are bent 90° at 52 and 54 intermediate their extents so as to have horizontal portions 56 and 58 respectively that are adapted to rest on a horizontal supporting surface or floor 60 while extending toward and in alignment with their counterparts of the mirror image frame section 32.

Means are provided to secure the frame sections 30 and 32 in adjustable spatial relationship. Such means comprises means 62 (see FIG. 3) connecting the frame portion 56 to its aligned counterpart 64. The means 62 comprises a rod 66 telescopingly received in the adjacent ends of the frame portions 56 and 64, with clamping screws 68 and 70 respectively threaded in the latter to releasably secure the rod 66 against relative movement therein.

In a similar fashion the tubular portion 58 is adjustably connected to its aligned counterpart 72 by means 74 (see FIG. 2) that includes a telescoping rod 76 and clamping screws 78 and 80.

The frame portion 44 is adjustably connected to its counterpart 82 by telescoping structure comprised of aligned tubular members 84 and 86 having their remote extremities detachably secured to the frame portions 44 and 82 by suitably threaded fastening means 88 and 90 that extend through such frame portions and into internally threaded extremities of the members 84 and 86, not shown.

Means 92 adjustably joins the adjacent ends of the members 84 and 86, such means comprising a rod 94 telescopingly received in the adjacent ends of the members 84 and 86. Clamping screws 96 and 98 in the members 84 and 86 serve to releasably secure the rod 94 against relative movement.

Means similar to those described in the preceding paragraph are provided for adjustably and releasably connecting the frame portion 50 to its counterpart 100, and such means (see FIG. 2) comprises aligned tubular members 102 and 104 secured to the frame portions 50 and 100, respectively, by threaded fastening means 106 and 108 that are similar to the threaded means 88 and 90. The adjacent ends of the member 102 and 104 are releasably and adjustably secured by means 110 similar to the previously described means 92 and includes a rod 112 and screws 114 and 116.

The frame sections 30 and 32 have generally the form of and strength of A-frames in virtue of structure now to be described. Such structure is identical for each of the frame sections 30 and 32, it will suffice to describe only such structural provision as made with respect to frame 30. Such structural provision comprises a horizontal tubular frame element 120 having its opposite ends detachably secured to the frame portions 44 and 50. In the preferred construction the extremities of the frame member 120 are flattened and apertured not shown, and disposed with the threaded means 88 and 106 extending through the apertures and thereby clamp the tubular member 120 between the threaded means 88 and 106 on one hand and the frame portions 44 and 50 on the other hand. It will be noted that such construction affords a degree of pivotal adjustment as between the frame member 120 and the frame portions 44 and 50.

Not only does the frame member 120 and its counterpart 126 constitute the frame sections 30 and 32 as A-frames, such tubular members 120 and 126 serve to support the seat 14 (see FIG. 10). The seat 14 is generally rectangular in form and rests upon the tubular members 120 and 126, and is positionable thereon in a forwardly and rearwardly adjustable position by reason of having a forward and rear extent considerably less than the longitudinal extents of the members 120 and 126 as apparent on inspection of FIG. 1.

The seat 14 is releasably secured in adjusted position on the members 120 and 126 by means of mounting clamps 130 that underlie the members 120 and 126 and which are releasably secured by cap screws 132 threaded into threaded recesses 134 in the underside of the seat 14. It will be noted that a plurality of spaced, internally threaded recesses 134 are provided in the seat 14 to accommodate various selections as to the spacing of the frame sections 30 and 32.

The leg exercising means 18 comprises a crankshaft 150 having its opposite ends journaled in bearings 152 and 154 that are releasably attached to the frame portions by U clamps 156 and nut bolt means 158 (see FIG. 6). It will be noted that the end extremities of the crankshaft 150 have lengths sufficient to accommodate adjustments in the spacing of the frame portions 44 and 82. The crankshaft 150 includes crank throws 160 and 162 that are angularly offset 180° from each other. The crank throws 160 and 162 are provided with sleeves 164 and 166 that are rotatable thereon and which constitute pedals to accommodate the feet 168 of the user 16 thereon. The crank throws 160 and 166 are axially spaced from each other by a central crank portion 170 and in the preferred construction means are provided to give bearing support to such crank portion 170. Such bearing support comprises a tubular member 172 having its opposite ends releasably secured to the rods 66 and 94 by suitable clamping means 174 and 176. A bearing 178, through which central crank portion 170 is journaled, is mounted on the tubular member 172 by means 180 that are similar to those shown in FIG. 6. It will be noted that the axial extent of the central crank portion 170 is sufficiently great to accommodate adjustment and spacing of the frame sections 30 and 32. If desired or deemed expedient adjustable stop collars, not shown, can be secured to the central crank portion 170 to prevent endwise movement of the latter in the bearing 178.

While a crank pedaling unit similar to the conventional pedaling unit of bicycles could be centrally journaled on the frame as will be readily apparent to those skilled in the art in the light of the foregoing description of the preferred crank means. The preferred crank means affords an advantage in stability and ruggedness for a give overall weight of components.

Directing attention now to the pivotal connections at the apices of the frame sections previously alluded to and noting that the same provided for frame section 32 is identical to that provided for frame section 30, only the latter is depicted and described in detail. Such means provided for the frame section 30 is best shown in FIG. 4 and is designated generally at 200.

As shown in FIG. 4, the adjacent upper ends of the frame elements 34 and 36 are flattened with aligned apertures through which extends an axial extension 202 of a bearing housing 204. The other end portion of the extension 202 has a nut 206 releasably threaded thereon to clamp the frame elements 34 and 36 in angularly adjusted relationship about the extension 202 between the nut 206 and the housing 204.

An antifriction bearing 208 is disposed in the housing 204 and is retained therein by the outer race thereof being engaged by set screws 212 in the housing 204.

The means 24 comprises a tubular guide 212 that has fixed thereto, intermediate its ends, a laterally extending boss or trunnion 214 that is suitably secured in a conventional manner to the inner race of the bearing 208.

An elongated operating element 216 slidably extends through the guide 212. A handle 218 is provided and the same is mounted on the forward end of the operating element 216 by mounting means that support the handle in a position that is laterally inwardly and downwardly offset from the operating element as best shown in FIGS. 1 and 2.

The operating element 216 is resiliently extensible by reason of being constituted of relatively movable forward and rear sections 220 and 222 that are, within the confines of the tubular guide 212, connected to each other by a coiled tension spring 224. The opposite ends of the spring 224 extend into the adjacent ends of the operating sections 220 and 222 and are secured thereto by pins 226 and 228 as clearly shown in FIG. 4. FIG. 4 shows the spring 224 in an extended position, and it will be understood that, in repose, the spring 224 draws the adjacent ends of the sections 220 and 222 into closer proximity to each other and preferably into abutting relationship.

In the preferred construction, the tubular guide 212 is of square or noncircular configuration, with the external configurations of the sections 220 and 222 being complementary thereto so as to prevent rotation of the sections 220 and 222 about axis of the guide 212.

The roller or massaging means 20 is mounted on the rear end of the operating element by a mounting means that includes a laterally extending tube 250 suitably fixed to the rear end of the operating element 216. A rod 252 is rotatably and axially slindingly received in the tube 250 and is secured in adjusted position by a set screw 254 in the tube 250. A leaf spring 256 is fixed to and extends laterally from the rod 252 as shown in FIG. 2, and the roller or massaging means 20 is mounted on the free end of the leaf spring 256. It should be noted at this point that the orientation of the steel leaf spring 256 is such as to afford resilient flexure of the roller 20 about an axis parallel to the rod 252, such rod being perpendicular to the extent of the operating element 216.

While the leaf spring 256 is shown extending upwardly as is preferred, rather than downwardly, it is evident that the same can be such as to extend downwardly. Indeed, should it be deemed expedient or desirable to do so, it is considered to be well within the skill of those in the art, as thus far advised, to attach to the rod 252 both upwardly and downwardly directed, roller equipped, leaf springs rather than the single, roller equipped, leaf spring illustrated and described.

The roller means or massaging means 20 comprises a U-shaped holder inclusive of a web portion 260 joining legs 262 and 264. The web has a rectangular recess 266 therein in which leaf spring 256 is removably received. Set screws 268 are provided in the web 260 for releasably retaining the leaf spring 256 in assembled relation.

A plurality of roller discs 270 are disposed between the legs 262 and 264 and are individually rotatable on a bolt 272 that extends through aligned apertures in the legs 262 and 264. The bolt 272 is retained in position by a nut 274. One of the roller or massaging discs 270 is shown in FIG. 8 wherein the knurled or toothed character of its outer periphery 276 is clearly shown.

The roller discs 270, which are spaced from each other by friction reducing washers 278 of plastic such as polyethylene of Teflon, are preferably of rubber of a softness such as not to be too harsh against the user's back.

The use of the exerssager 10 will be readily understood.

The frame 12 is adjusted in width appropriate to the size of the user, and the seat 14 is positioned to seat the user's comfort in relation to the leg exercising means 18 and/or the guide 212 and its counterpart 280.

The user 16 then grasps the handle 218 and its counterpart 282 in his hands, and places his feet on the pedals 164 and 166. He can then pedal at any pace convenient or comfortable to himself or not at all if he desires.

Concurrently, the user can push forward on the handle 218 to cause forward movement of the operating element 216 and engagement of the roller or massaging means 20 with his back with a pressure that is a function of how hard he pushes forward on the handle 218. He may use the handle 218 in an obvious manner to reciprocate the operating element 216 and consequent pummelling of the roller 20 against the back. Moving the handle 218 up and down causes up and down movement of the roller 20 relative to the back and such up and down movement can be coordinated with whatever reciprocation or lack of reciprocation of the operating element in its guide 212 may be desired. The coiled spring 224 and the leaf spring 256 accommodate for variations in the contour of the back and contributes to maintaining a steady massaging pressure without having to effect any substantial endwise movement of the forward section 220 of the operating element 216 in its guide 212.

It will be manifest that the adjustability of the rod 252 engages the forward and rear spacing of the roller 20 from the handle 218 to be variable and made to better accommodate users of differing size, especially as to arm length.

Aluminum is the preferred material of construction except where applied forces or stress indicate steel to be a better choice.

Having fully described the invention as to its structure and use, attention is now directed to the appended claims for ascertainment of the actual scope of the invention.

I claim:

1. Therapeutic apparatus comprising a frame, a pair of laterally spaced guide means pivotally mounted on the frame for vertical swinging movement about aligned horizontal axes, an elongated element operatively associated with each of said guide means to be guided by the latter for longitudinal reciprocation relative thereto, each of said operating elements having forward and rear ends with a handle fixed to the forward end, and each of said operating elements being provided at its rear end with a back massaging means that is laterally offset toward the other operating element, whereby a forwardly facing user positioned between the laterally spaced guide means can manipulate the handles to cause the massaging means to contact his back with a manually controllable force while moving upwardly and downwardly thereagainst.

2. The combination of claim 1, wherein a user's seat is carried by the frame at a position laterally intermediate and below the pivotal mountings of the guide means.

3. The combination of claim 2, together with a laterally extending crankshaft mounted on the frame for rotation about a horizontal axis parallel to the previously mentioned axes and disposed below the seat, said shaft having two throws that are 180° apart in rotation that are adapted to accommodate the feet of the user as pedals, whereby a seated user can exercise his legs.

4. The combination of claim 3, wherein the crankshaft is mounted on the frame by means enabling detachment of the crank from the frame.

5. The combination of claim 3, wherein the crank throws are axially spaced from each other with a central portion of the crankshaft extending therebetween, and a bearing means carried by the frame providing support for the central portion of the crankshaft that is journaled therethrough.

6. The combination of claim 3, wherein the crankshaft has opposite end portions, with each of said end portions being journaled in the frame.

7. The combination of claim 1, wherein said frame comprises a pair of connected and laterally spaced A-frames, each of said A-frames comprising forward and rear legs that converge upwardly to define an apex, with said guide means being pivoted to the A-frames at the apices of the latter.

8. The combination of claim 7, wherein the guide means are pivotally mounted on the A-frames by means inclusive of antifriciton bearings.

9. The combination of claim 7, wherein one of the guide means is pivoted to its respective A-frame by means comprising one race of an antifriction bearing being secured to the apex of such A-frame with the guide means being secured to the other race of said antifriction bearing.

10. The combination of claim 7, wherein a seat is carried by and disposed to extend between the A-frames.

11. The combination of claim 7, wherein the legs of the A-frames include telescoping members afforded adjustment in length with means being provided to releasably secure the telescoping members in adjusted relationship.

12. The combination of claim 1, wherein each of the massaging means comprises a roller.

13. The combination of claim 12, wherein each of said rollers is segmented with each segment being rotatable independently of the other segments.

14. The combination of claim 12, wherein the roller is carried on the operating element by a resilient means enabling resilient movement of the roller in a forwardly and rearwardly direction.

15. The combination of claim 1, wherein said operating element is resiliently extensible.

16. The combination of claim 15, wherein each of said guide means comprises a tubular body, and wherein said operating element includes forward and rear sections slidably extending into the front and rear sections of the tubular body respectively, and yieldingly extensible means disposed within the tubular body connecting the sections.

17. The combination of claim 16, wherein tubular body and the sections are noncircular in transverse section, whereby rotation of the sections in the tubular body is prevented.

* * * * *